US005482202A

United States Patent [19]

Wen

[11] Patent Number: 5,482,202

[45] Date of Patent: Jan. 9, 1996

[54] DRINK BOX WITH BUILT-IN STRAW

[76] Inventor: Chung-hsin Wen, No. 9, Lane 24, Tawu St., Tainan, Taiwan

[21] Appl. No.: 458,124

[22] Filed: Jun. 2, 1995

[51] Int. Cl.[6] ..... B65D 5/72; B65D 25/38

[52] U.S. Cl. ..... 229/103.1; 220/705; 220/707

[58] Field of Search ..... 229/103.1; 220/705–710; 215/388, 389

[56] References Cited

U.S. PATENT DOCUMENTS

| | | | |
|---|---|---|---|
| Re. 25,448 | 9/1963 | Cohen et al. | 229/103.1 |
| 2,949,217 | 8/1960 | Pugh, Sr. | 229/103.1 |
| 3,071,303 | 1/1963 | Pugh | 220/707 |
| 3,303,984 | 2/1967 | Jurena | 229/103.1 |
| 3,325,076 | 6/1967 | Soucy | 229/103.1 |
| 3,656,654 | 4/1972 | Brinkley, III | 229/103.1 |
| 3,730,737 | 5/1973 | Harvey et al. | 229/103.1 |
| 4,265,363 | 5/1981 | Conn | 215/388 |
| 4,690,294 | 9/1987 | Jones | 229/103.1 |
| 5,148,971 | 9/1992 | Ahn | 229/103.1 |
| 5,188,283 | 2/1993 | Gu | 229/103.1 |

*Primary Examiner*—Gary E. Elkins
*Attorney, Agent, or Firm*—Hedman, Gibson & Costigan

[57] ABSTRACT

A drink box with a built-in straw comprises a container and a freely-deformable straw. The straw includes an upper end portion attached to an intersection of an upper sealing edge and an integral tip portion of the container, a lower end portion attached to a lower sealing edge of the container and a middle portion properly dimensioned in the container. A respective semi-perforated secant is made at a junction between the tip portion and the rest of the container and a junction between the upper end portion and the rest of the straw so that a respective part of the container and the straw can be detached. After detachment, the remaining straw is ready for use as a usual one.

11 Claims, 7 Drawing Sheets

DRINK BOX WITH BUILT-IN STRAW

BACKGROUND OF THE INVENTION

1. Field of the Invention

The present invention relates to a drink box with built-in straw, more particularly, the present invention relates to a drink box having two end portions of a straw attached thereon and a middle portion kept in the box.

2. Prior Art

The increasing demand for conveniently available beverages has lead to the simple packaged drink which can be kept fresh without refrigeration. The current simple packaged drink is usually stored in a container made of paper. A straw packaged separately is attached on an outer surface of the container. The container includes a hole on a top thereof for inserting straw. This prior art combination of drink packages may have a certain number of disadvantages, for example, the straw may drop into the container because of its limited length and in the case of a consumer being in a turbulently-moving vehicle, the straw would not easy to be insert, also the straw may fall away because of its inadequate attachment on the outer surface of the container.

The above recited disadvantages are overcome by the drink box with built-in straw of the present invention which provides a more convenient and hygienic package.

SUMMARY OF THE INVENTION

A drink box with built-in straw in accordance with the present invention generally includes a container for storing drink and a freely deformable straw with two end portions each attached on an upper edge and a lower edge of the container and a middle portion kept in the container. The container further comprises an extended portion connected to the straw that can be partially pulled out.

In accordance with one aspect of the present invention, there is provided an integral combination of the straw and the container without any additional component, thereby to meet the needs of convenience and hygiene.

In accordance with another feature of the present invention, various forms and shapes of the straw can be provided for use because the straw's spatial location inside the container is essentially unlimited.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
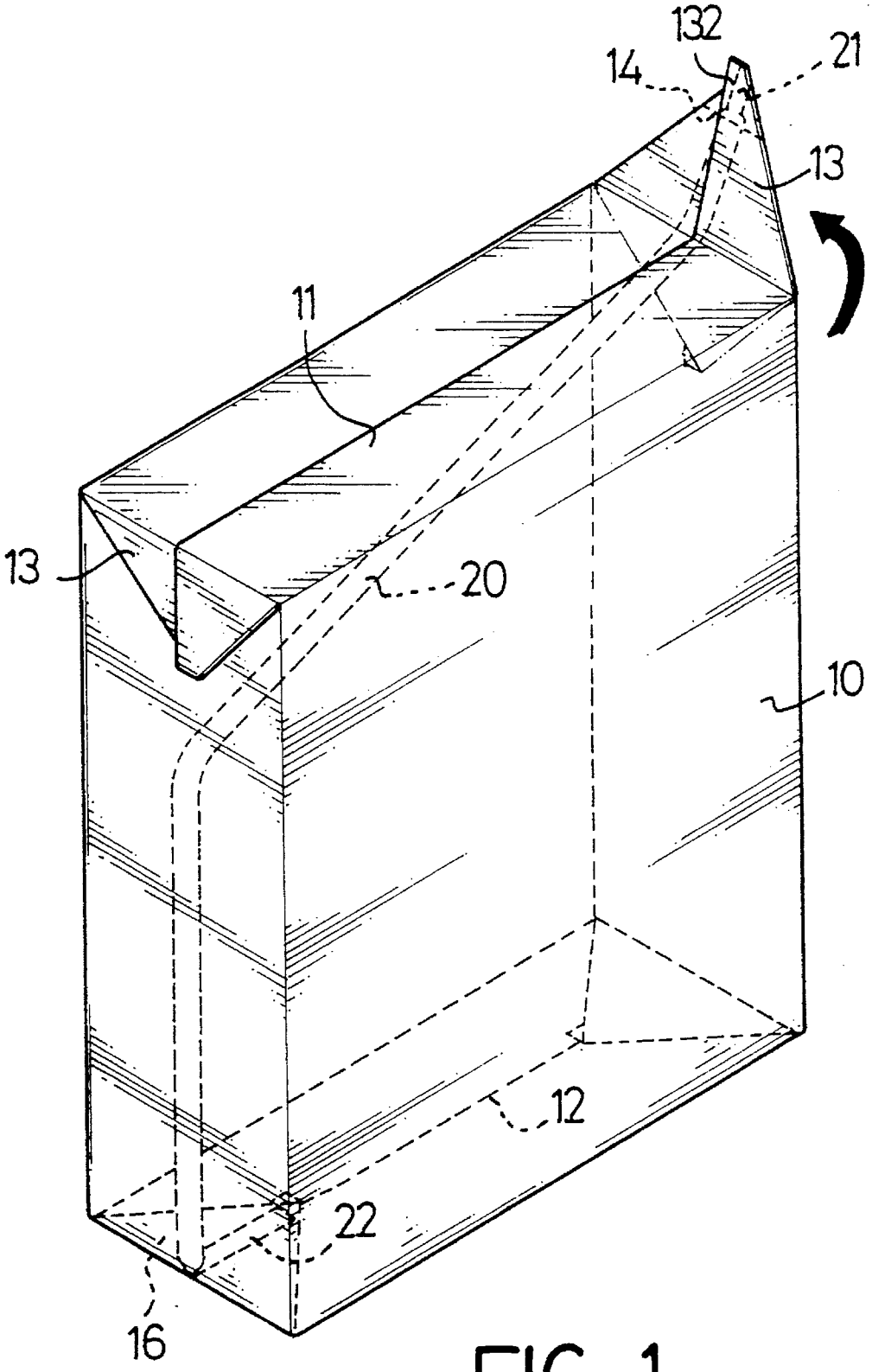
FIG. 1 is a schematic view showing a drink box containing a built-in straw in accordance with the present invention.
Figure 4:
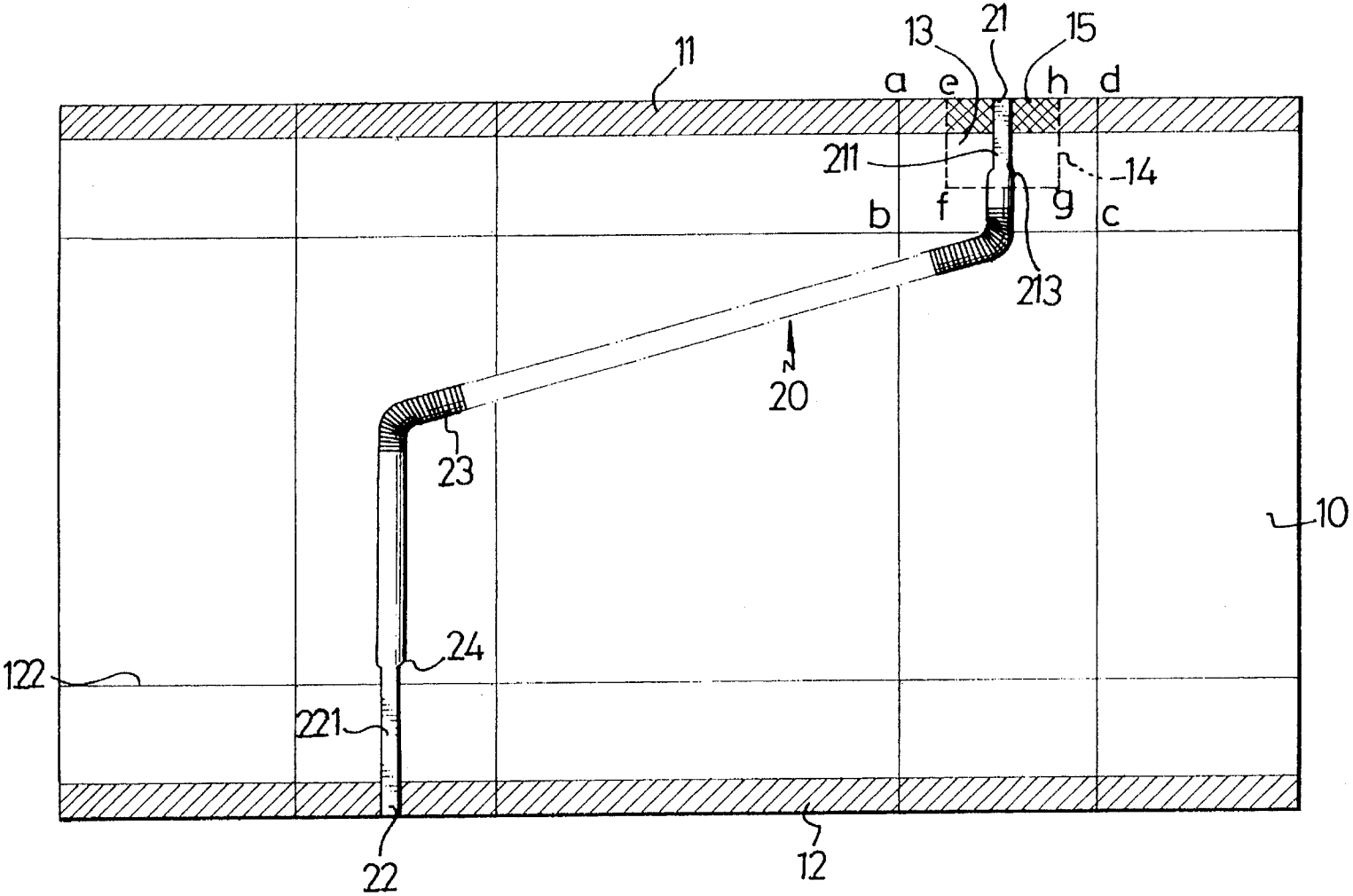
FIG. 4 is a schematic view of the drink box unfolded to show the connection between the straw and the sheet forming the box structure in accordance with the present invention.

Referring to the drawings and initially to FIG. 1 and FIG. 4, a drink box with built-in straw in accordance with the present invention comprises a container 10 and a straw 20. The container 10 for preserving drink is generally of a conventional construction made of paper with one face coated with foil or like materials and includes an upper sealing edge 11 and a lower sealing edge 12. One face of each of the upper and lower sealing edges 11 and 12 is to be applied with adhesives (indicated by hatched lines in FIG. 4) prior to forming the container 10. Integral with the container 10 and comprising a part of the upper sealing edge 11 is a pair of upper flaps 13. In FIG. 1, one flap 13 associated with the straw 20 is shown lifted up in a direction as indicated by an arrow sign prior to use. A semi-perforated line or secant 14 is made in the flap 13 so as to define a tip portion 132 that can be detached from the rest of the flap 13. FIG. 4 shows an unfolded configuration wherein the tip portion 132 expands to the area enclosed by characters a-b-c-d, the tip portion 132 to the area e-f-g-h and the secant 14 is shaped like character 'U' indicated by dotted lines, respectively. While a straight semi-perforated line is shown, it is understood that a line configuration other than straight can be equally adopted. In this case, the secant will be a more rounded 'U' character.

The straw 20 includes an upper end portion 21, a lower end portion 22 and a middle portion 23. The upper end portion 21 is secured to a superimposition area 15 of the upper sealing edge 11 and the tip portion 132 as indicated by double hatched lines in FIG. 4. The lower end portion 22 is attached on the lower sealing edge 12 in a like manner as may be by gluing or hot pressing. The middle portion 23 may suitably be in a form of bellows and is shaped and situated between the two end portions 21 and 22 to permit an unrestrained conveying of drink in the container 10. While the upper and lower end portions are shown attached to respective upper and lower sealing edges by a lengthwise length of the end portion extending approximately a whole width of the sealing edge, the lengthwise length may be much shorter than the width so that the straw is secured to the sealing edges by only a respective short portion thereof.

To insure a proper attachment, each of the upper end portion 21 and lower end portion 22 of the straw 20 is cut along a portion of its length to leave an attachment section 211 or 221 which has an angular span in cross-section about the axis of the straw substantially less than 180 degrees. Moreover, in order to make a face or area contact with corresponding edge 11 or 12 when in the condition of FIG. 4, the attachment section 211 is essentially planar at least at the segment making actual contact with the edge 11 or 12. If desired, the transition or junction between the attachment section 211 or 221 and the rest of the straw 20 can be reduced in dimension to an extent as small as possible to thereby obtain an approximately planar attachment section 211 or 221.

Figure 2:
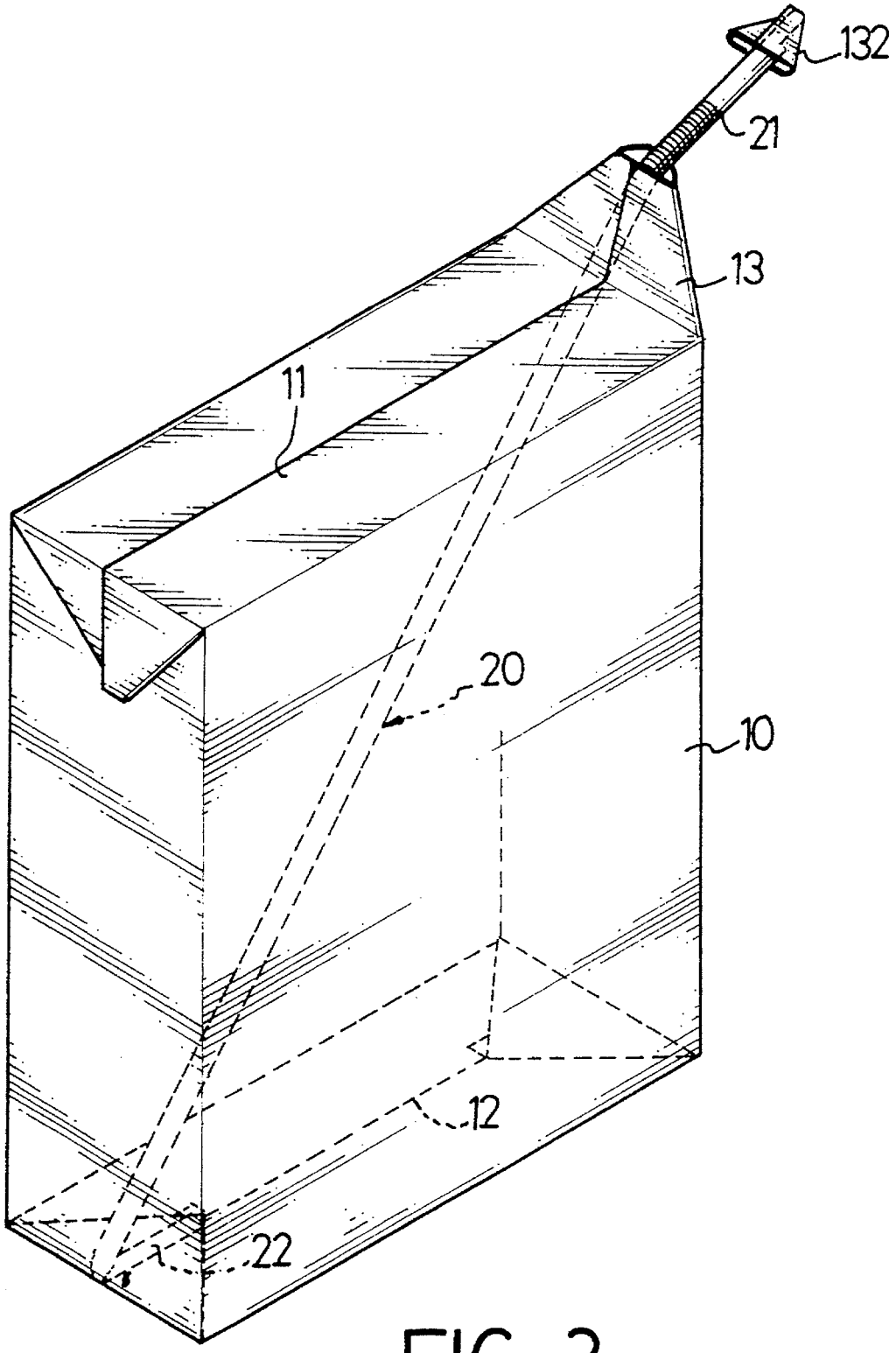
FIG. 2 shows a subsequent state of the drink box of FIG. 1 in which a portion of the container is detached to expose the straw.

In the embodiment of FIGS. 1 through 4, the length of the middle portion 23 of straw 20 is larger than the diagonal distance from one lower flap 16 and an opposite upper flap 13, i.e., the straw 20 is slack in the container 10 prior to its use. The straw 20 can therefore be partially pulled by extending the straw 20 straight for subsequent use after detaching the tip portion 132 along the secant 14, as shown in FIG. 2. While the straw is slack within the container prior to its use, it may be that the lower portion 22 can be situated directly below the upper portion 21. In this case, the upper and lower portions 21 and 22 are in line and no slack is necessary except that a bellow-like middle portion is again provided. Alternatively, a slack of the straw is still provided if desired.

Figure 3:
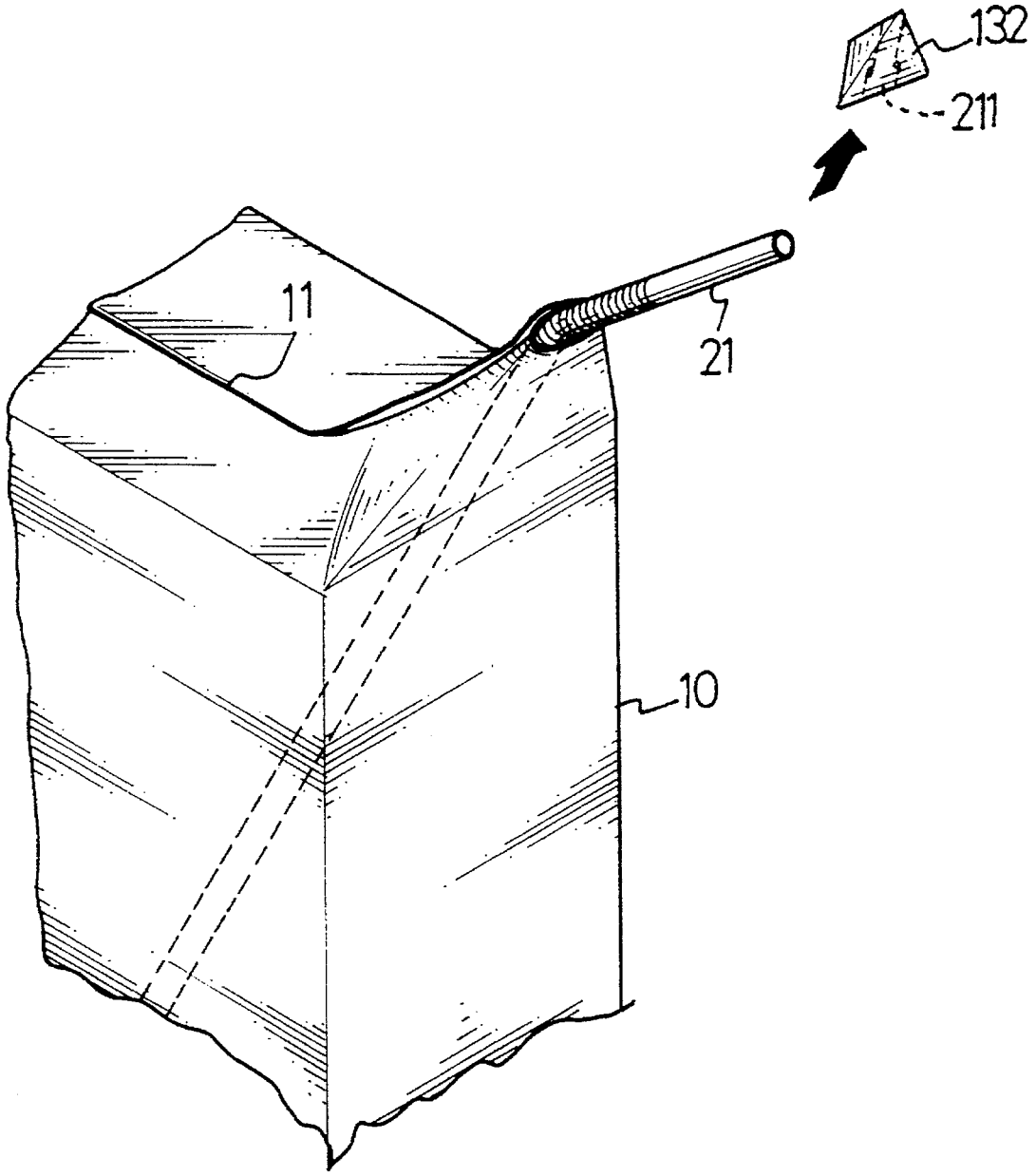
FIG. 3 shows, in a partially broken away view, a subsequent state of the drink box shown in FIG. 2 in which a portion of the straw is detached to present an end ready for use.

Referring particularly to FIGS. 3 and 4, the connection between the upper portion 21 and the middle portion 23 is made easy to break by providing a semi-perforated line 213 thereat. The position of the semi-perforated line 213 is preferably around the secant 14 and beyond the attachment section 211 so that after breakage the straw protruding out can be used as usual without any non-cylindrical portion present.

In view of the above, the manufacture of the drink box with built-in straw in accordance with the invention is apparent and generally comprises first attaching the attachment sections 211 and 221 of the upper and lower end portions 21 and 22 to the package material making the container, with the middle portion 23 properly situated. A junction 24 between the attachment section 221 and the rest of the straw should be slightly above the bottom of the container so that flow of the drink within the container will not be blocked. This can be insured by positioning the junction 24 above the folding line 122 (cf. FIG. 4). Then, a semi-perforated line 213 is made to the straw 20. After proper placement of the straw 20, the package material of the container is folded and sealed in a conventional manner.

Referring again to FIGS. 1 to 3, there are shown successive conditions for the use of the present invention. In FIG. 1, first the extended flap 13 with the secant 14 thereon is lifted, then as shown in FIG. 2, the straw 20 is partially pulled out subsequent to detaching the tip portion 132 of the flap 13 being detached because the attachment section 213 of the upper end portion 21 is attached to the superposition area 15 of the upper sealing edge 11 and the flap 13. In FIG. 3, the attachment section 211 is broken from the straw 20 along the semi-perforated line 213 formed in advance.

Figure 5:
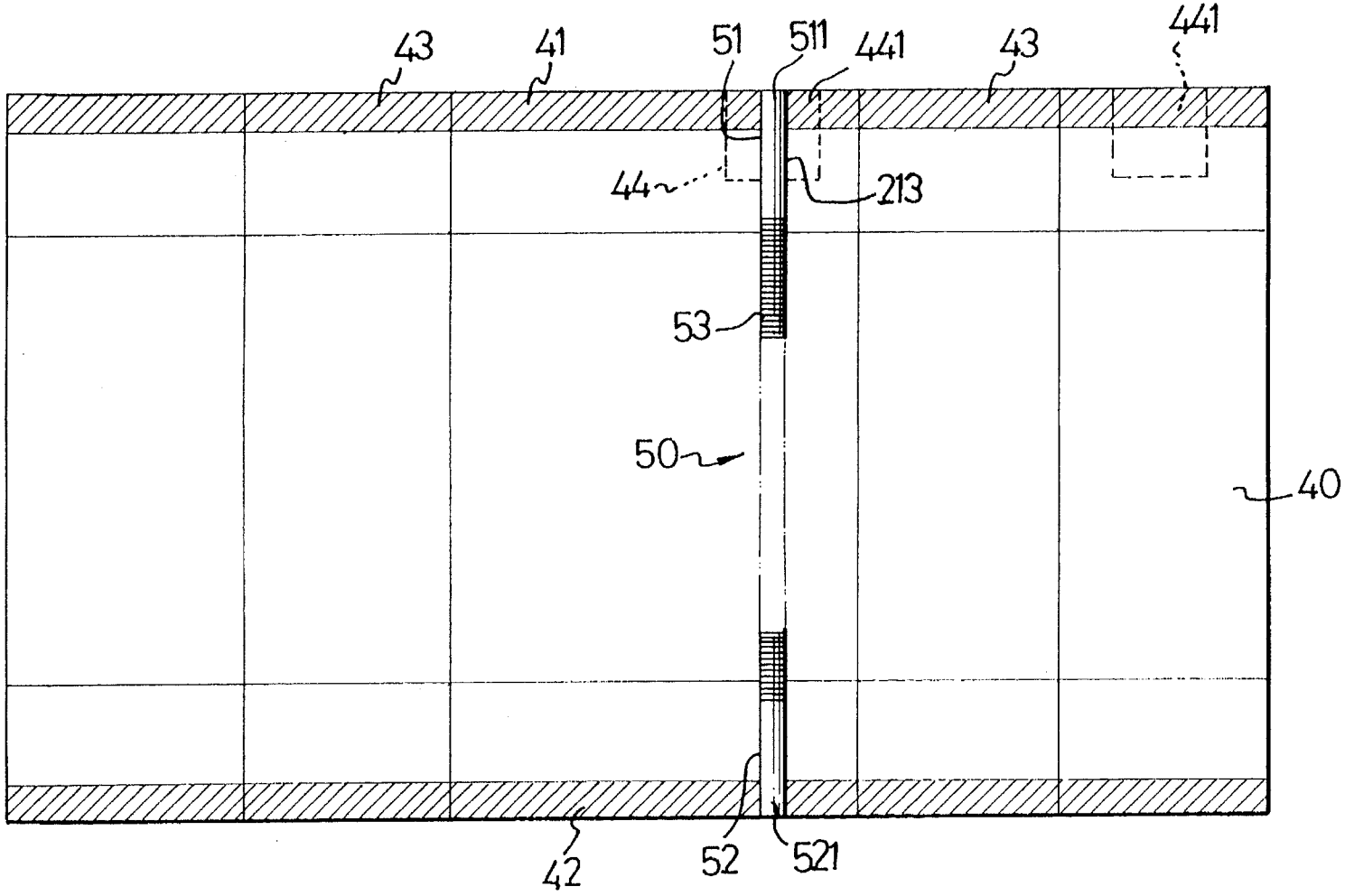
FIG. 5 is a schematic view of another embodiment of the drink box unfolded to show the connection between the straw and the sheet forming the box structure in accordance with the present invention.
Figure 6:
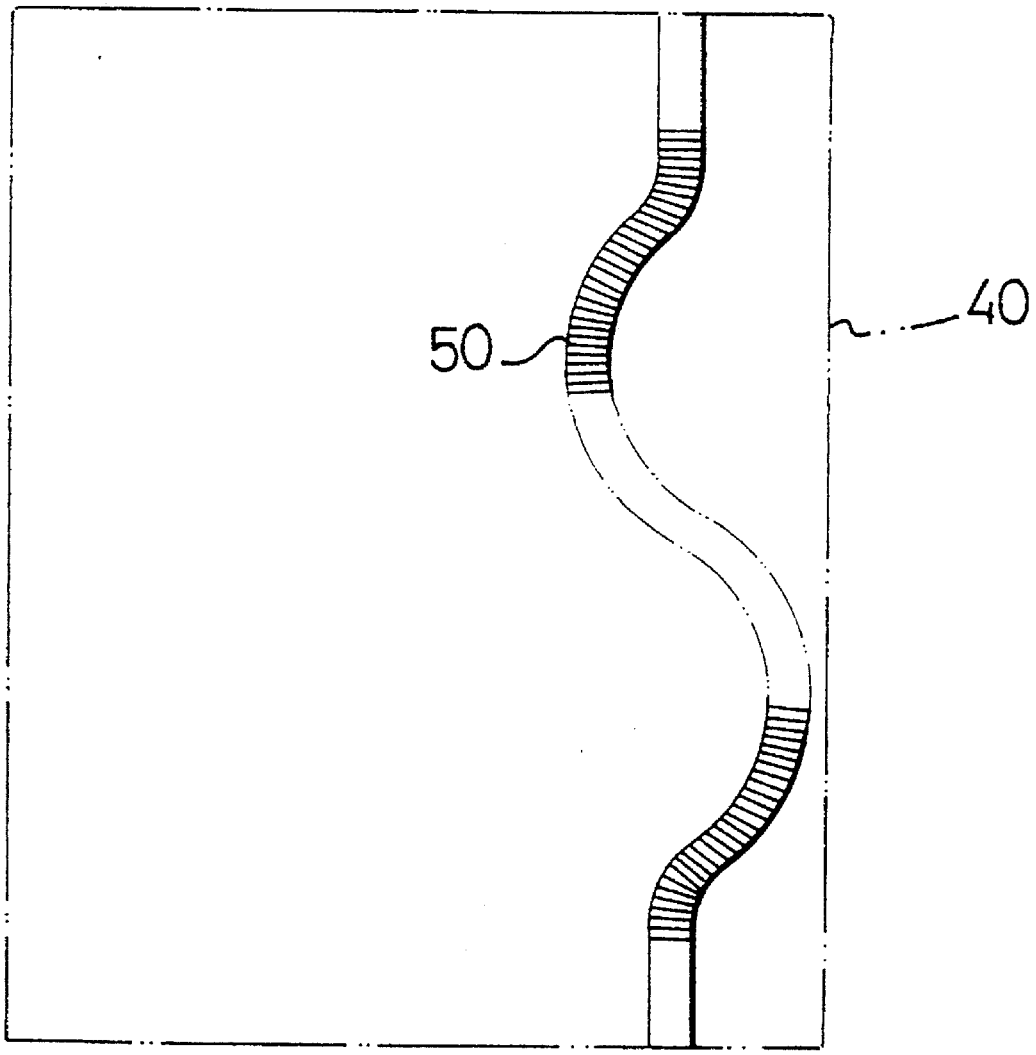
FIG. 6 is a schematic view of the drink box shown in FIG. 5, showing the state of the straw inside the container.
Figure 7:
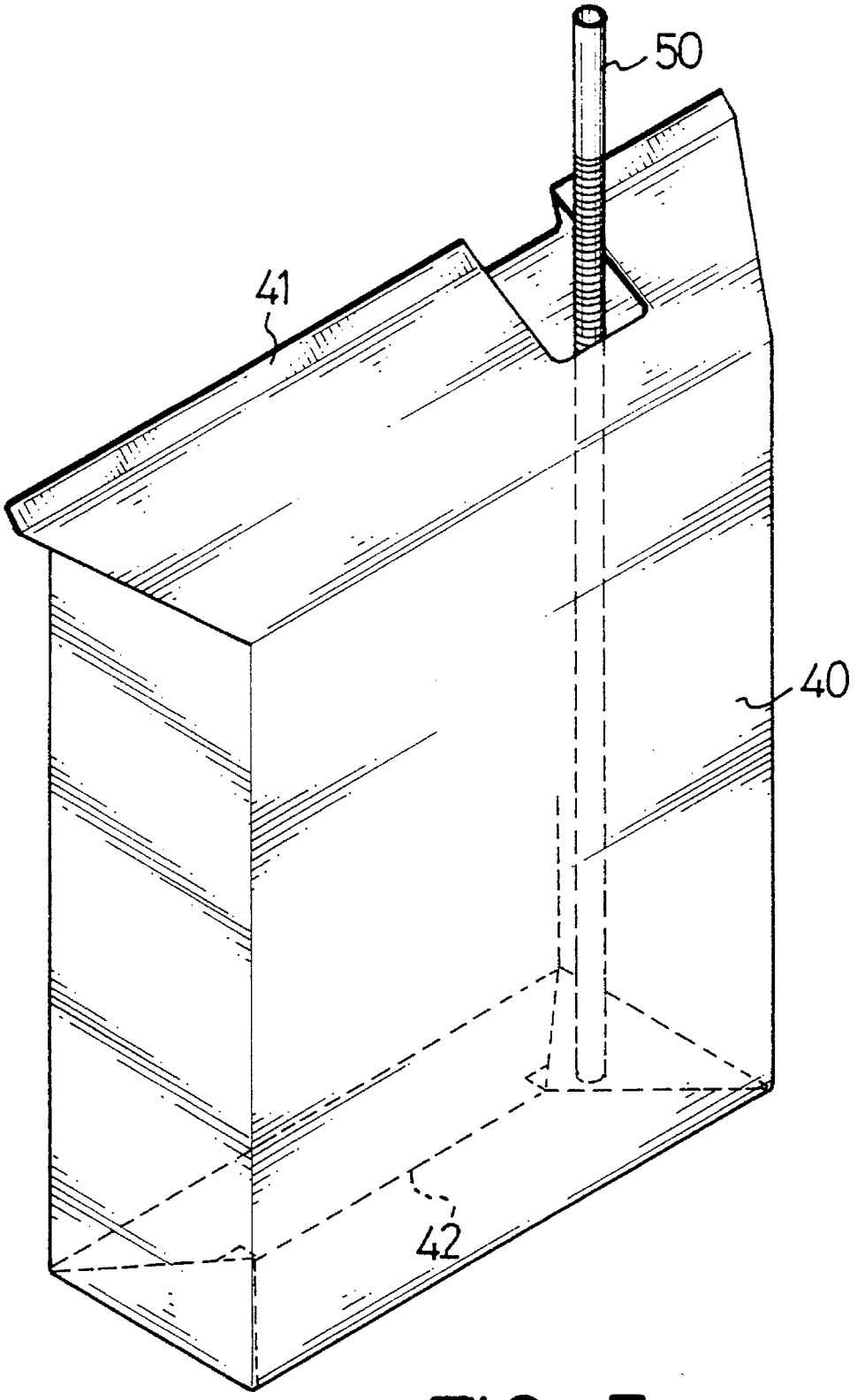
FIG. 7 is a schematic view of the drink box in accordance with the embodiment shown in FIGS. 5 and 6.

Referring to FIGS. 5, 6 and 7, there is shown another embodiment of the drink box in accordance with the present invention. In this embodiment, wherein the straw 20 and the container 40 have substantially the same configuration as above-mentioned drink box, the upper end portion 51 of the straw 50 is attached on the upper sealing edge 41 of the container 40 and the lower end portion 52 is attached on the lower sealing edge 42 in a manner as shown in FIG. 5. A secant 44 is likewise made in the container but at or adjacent an intermediate part of the upper sealing edge 41 between a pair of upper flaps 43. The secant 44, when the container 40 is in an unfolded condition of FIG. 5, is decomposed into a respective character 'U' semi-perforated line indicated by dotted lines in FIG. 5 on both sides of one unfolded flap 43. Bordered by the semi-perforated lines are tip portions 441 which can be easily detached from the rest of the container 40. The middle portion 53 of the straw 50 may suitably be in a form of bellows and is shaped and situated between the two end portions 51 and 52 to permit an unrestrained conveying of drink in the container 40 as shown in FIG. 6. In this case, the location of the straw 50 prevents the possibility that it be squeezed to deform, as might occur to the embodiment of FIGS. 1 through 4, by the junction of the flap to the container body when the container is packed and prior to opening the flaps.

The manufacture of this embodiment of the drink box with built-in straw in accordance with the invention is substantially of a similar way as above-mentioned embodiment. Namely, attach the attachment section 511 and 521 of the upper and lower end portion 51 and 52 to the upper and lower sealing edges 41 and 42 on the package material making the container 40, with the middle portion 53 properly situated, as shown in FIG. 5.

Referring to FIG. 7, there is shown the state of use of this embodiment after removing tip portion 441 consisted of a part of the upper sealing edge 41 and a part of the container body. With the tip portion 441 torn off, the straw 50 is partially pulled out because of the straw's attachment to the upper sealing edge 41. At last, the attachment section 511 is broken from the straw 50 along the semi-perforated line formed in advance for example at a position as shown.

Accordingly, the drink box with built-in straw in accordance with the present invention is convenient for use and substantially meets the need of hygiene requirements of food products.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A drink box with a built-in straw comprising:

a container for preserving drink having an upper sealing edge and a lower sealing edge;

a tip portion integral on the container and comprising a part of the upper sealing edge, the tip portion being detachable from the rest of the container;

a straw being composed of an upper end portion, a lower end portion and a middle portion connecting the two end portions, the upper end portion being attached on a superimposition area of the upper sealing edge and the tip portion, the lower end portion being attached on the lower sealing edge, the middle portion being able to extend a lengthwise distance in response to a movement of the upper end portion with respect to the lower end portion; and a semi-perforated line being formed adjacent to a junction between the upper end portion and the middle portion of the straw, the straw being easily breakable along the semi-perforated line to separate a segment thereof together with the detached tip portion from the rest of the straw, thereby exposing the remaining straw for access from outside.

2. The drink box with a built-in straw as claimed in claim 1, wherein a semi-perforated secant is made to the container, the semi-perforated secant bordering the tip portion from the rest of the container.

3. The drink box with a built-in straw as claimed in claim 2, wherein the semi-perforated secant is made on an upper flap of the container.

4. The drink box with a built-in straw as claimed in claim 1, wherein the upper and lower end portions of the straw each have a substantially planar attachment section for making a face contact with the corresponding sealing edge, the semi-perforated line on the upper end portion being located outside the attachment section.

5. The drink box with a built-in straw as claimed in claim 1, wherein the middle portion of the straw comprises a bellows.

6. The drink box with a built-in straw as claimed in claim 1, wherein the middle portion of the straw is slack within the container.

7. A drink box with a built-in straw comprising:

a container for preserving drink having an upper sealing edge and a lower sealing edge;

a straw retained within the container and having an upper attachment section attached on the upper sealing edge, a lower attachment section attached on the lower sealing edge, and a flexible middle portion extendable in a lengthwise direction between the upper and lower attachment sections; and a semi-perforated line being formed adjacent to a junction between the upper attachment section and the flexible middle portion, the upper attachment section being easily breakable along the semi-perforated line to separate from the rest of the straw, the container having a portion which includes a part of the upper sealing edge to which the upper attachment section is attached and which is able to be detached from the rest of the container, together with the upper attachment section detached from the rest of the straw, to extend out and expose the remaining straw for access from outside.

8. The drink box with a built-in straw as claimed in claim 7, wherein a semi-perforated secant is made on the container to border a tip portion from the rest of the container, the tip portion substantially corresponding to said portion of the container which includes a part of the upper sealing edge where the upper attachment section is attached and facilitating it to be easily detachable from the rest of the container.

9. The drink box with a built-in straw as claimed in claim 8, the semi-perforated secant is at a position adjacent to an intermediate of the upper sealing edge between a pair of upper flaps of the container.

10. The drink box with a built-in straw as claimed in claim 7, wherein the middle portion of the straw comprises a bellows.

11. The drink box with a built-in straw as claimed in claim 7, wherein the middle portion of the straw is slack within the container.

* * * * *